United States Patent [19]

Dunphy et al.

[11] 4,434,634

[45] Mar. 6, 1984

[54] LOCK

[75] Inventors: Gerald F. Dunphy; Lance E. Best, both of Melbourne, Australia

[73] Assignee: Ogden Industries Pty. Limited, Victoria, Australia

[21] Appl. No.: 327,254

[22] Filed: Dec. 1, 1981

[30] Foreign Application Priority Data

Dec. 2, 1980 [AU] Australia ..... PE6720

[51] Int. Cl.[3] ..... E05B 65/00; E05C 1/04

[52] U.S. Cl. ..... 70/89; 70/386; 292/153

[58] Field of Search ..... 70/89, 90, 386; 292/DIG. 47, 252, 32, 42, 153, 337

[56] References Cited

U.S. PATENT DOCUMENTS

| | | | |
|---|---|---|---|
| 554,633 | 2/1896 | Lasar | 292/42 |
| 565,168 | 8/1896 | Jarvis | 70/90 |
| 1,012,418 | 12/1911 | Obenchain | 292/42 |
| 3,530,262 | 9/1970 | Hawkins | 70/90 |
| 3,667,263 | 6/1972 | Rogers | 70/89 |
| 3,744,283 | 7/1973 | Schmidt | 70/90 |
| 3,877,261 | 4/1975 | Robins | 70/90 |
| 3,934,908 | 1/1976 | Rifkin | 70/89 X |
| 4,030,321 | 6/1977 | Kenyon | 70/386 X |
| 4,229,955 | 10/1980 | Coralli et al. | 70/89 X |
| 4,351,170 | 9/1982 | Clompus | 70/90 |

FOREIGN PATENT DOCUMENTS

| | | | |
|---|---|---|---|
| 639639 | 7/1950 | United Kingdom | 70/89 |
| 1448639 | 9/1976 | United Kingdom | 70/90 |
| 2076883 | 12/1981 | United Kingdom | 70/89 |

*Primary Examiner*—Thomas J. Holko
*Assistant Examiner*—Lloyd A. Gall
*Attorney, Agent, or Firm*—Berman, Aisenberg & Platt

[57] ABSTRACT

A door or window lock has a body which is securable to the door, window, or a surround for a door or window, and has at least two passages therethrough that extend angularly relative to one another. A locking bar is slidable axially in any one of the passages to adopt either an operative position or an inoperative position, and in the operative position a locking end portion of the bar protrudes a predetermined distance beyond an adjacent side of the body. The bar can adopt either of two operative positions for each passage and in each of those positions the locking end portion protrudes beyond a respective one of two opposite sides of the body. A key operated locking member is rotatably mounted on the body and can adopt a particular locking position for each of the passages. In the locking position for one passage, the locking member protrudes into a recess of the bar to hold the bar against movement in either direction from its operative position. In the locking position for the other passage, the locking member influences an intermediate member to protrude into the bar recess when the bar is in the operative position for that passage. Spring retainers function to releasably locate the bar in each of its operative positions.

10 Claims, 15 Drawing Figures

LOCK

This invention relates to locks, particularly those used for locking doors and windows although the invention is also applicable to locks used in other situations. It will be convenient to hereinafter describe the invention with particular reference to locks adapted for use with doors and windows.

Window and door locks are generally designed for use in a particular situation. For example, a sliding door lock is not normally usable on a swinging door. Similarly in the case of windows, different locks are generally required for sliding, double hung, awning and casement windows respectively. Still further, for both doors and windows it has been common to require different styles of locks according to whether the frame of the door or window is made of timber or metal. As a result, lock manufacturers have been required to produce a large range of locks to meet the various use situations.

One particular form of lock developed primarily for window and sliding doors, includes a bar which is slidable through a lock body in the unlocked condition and is held against movement relative to the body in the locked condition. In the locked condition, the bar projects from the body to engage an appropriate striker or to locate within a hole or recess. There are several disadvantages of such locks. One disadvantage is the need to provide several forms of the lock to meet different use situations as discussed above. Another disadvantage is the lack of retention of the locking bar in the unlocked condition so that it must be separated from the body for storage.

It is a principle object of the present invention to provide a lock of the kind indicated which is versatile in that it can be used in a variety of different situations. It is a further object of the invention in a preferred form to provide such a lock having a locking bar which is retained in assembly with the lock body when in the unlocked condition.

According to the present invention, there is provided a lock including a body adapted to be secured to a support, at least two passages formed through said body and each having its longitudinal axis arranged angularly relative to the longitudinal axis of the other, a locking bar slidably receivable in any one of said passages to be movable longitudinally relative to said body between an operative position and an inoperative position and locking means mounted on said body and being operable to releasably secure said locking bar in said operative position in any one of said passages.

The essential features of the invention, and further optional features, are described in detail in the following passages of the specification which refer to the accompanying drawings. The drawings however, are merely illustrative of how the invention might be put into effect, so that the specific form and arrangement of the features (whether they are essential or optional features) shown is not to be understood as limiting on the invention.

Figure 1:
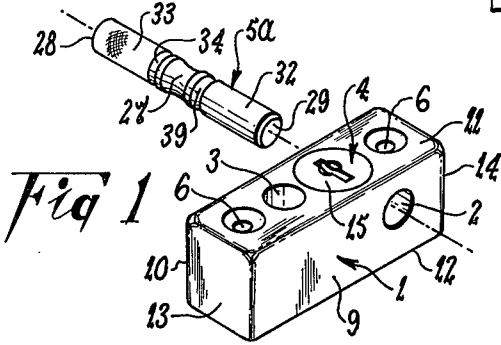
FIG. 1 is a perspective view of a lock according to one embodiment of the invention.

An example lock according to the invention is shown in FIG. 1 and in that example the body 1 is provided with two bar receiving passages 2 and 3 which are arranged substantially at right angles to one another. In other arrangements however, there may be more than two passages and the passages (two or more) may be disposed relative to one another at an angle other than a right angle. It is a feature of the construction shown that common locking means 4 is operable to act upon a locking bar 5 when that bar 5 is located in either of the two passages 2 and 3.

Figure 3:
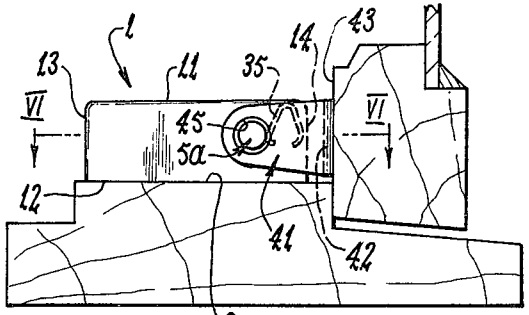
FIG. 3 is a side elevational view of the assembly shown in FIG. 2.
Figure 2:
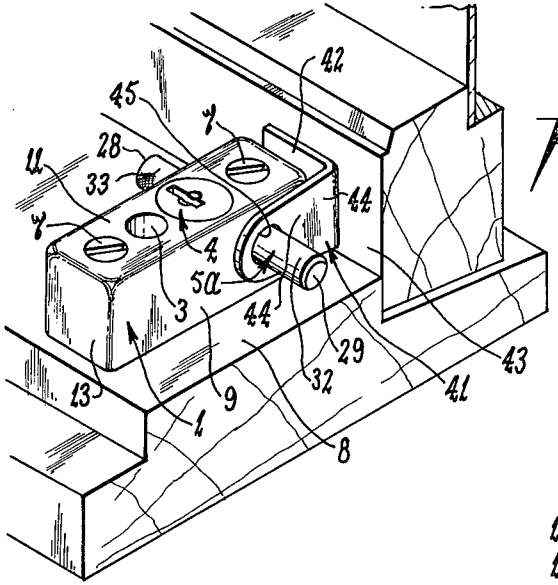
FIG. 2 is a view similar to FIG. 1 but showing the lock mounted on an awning window.

In the particular construction shown, the lock body 1 is in the general form of an elongate six sided block which may be generally square or rectangular in cross section. The body 1 can be relatively small in size—for example, it may be approximately 22 mm wide, 22 mm deep and 60 mm in length. The body 1 may be secured to a support in any appropriate manner, but as shown it preferably has mounting holes 6 for receiving mounting screws 7, bolts or the like to secure the body 1 to a support surface 8 (FIG. 2). One-way screws may be used if desired to inhibit demounting of the lock body 1.

Each of the two passages 2 and 3 extends completely through the body 1 from one side thereof to another. That is, in the preferred form shown, the passage 2 extends between two opposite sides 9 and 10 of the body 1 whereas another passage 3 extends between the other two sides 11 and 12. In an alternative form however, one of the passages 2 or 3, or an additional passage, may extend longitudinally of the body 1 to pass through the ends 13 and 14. Each passage 2 and 3 is preferably in the form of a cylindrical bore as shown.

Figure 6:
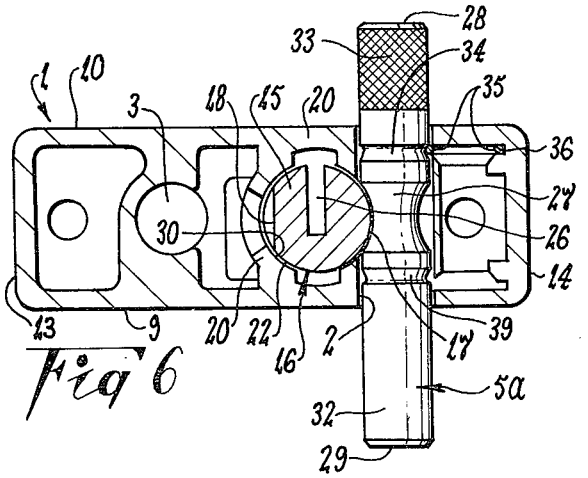
FIG. 6 is a cross-sectional view taken along line VI—VI of FIG. 3.
Figure 7:
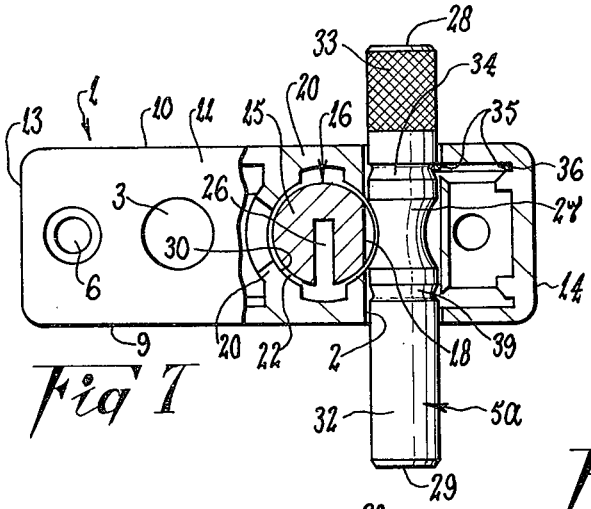
FIG. 7 is a view similar to FIG. 6 but showing the locking member turned to the unlocking or bar release position.
Figure 8:
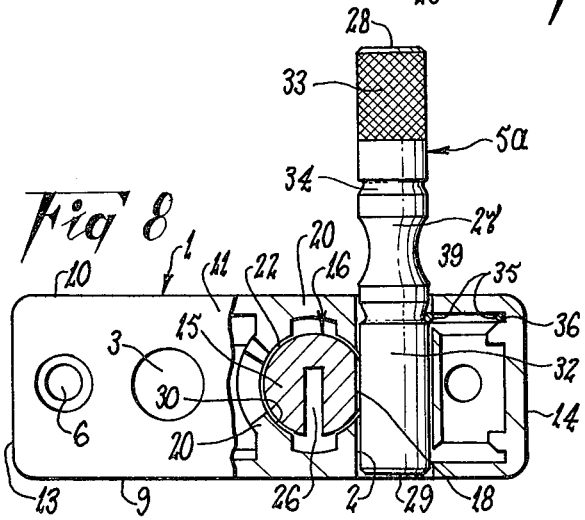
FIG. 8 is a view similar to FIG. 7 but showing the locking bar withdrawn into the inoperative position.

Also in the preferred form shown, the locking means 4 includes a primary locking member 15 which is rotatably mounted in the body 1 and has on its radially outer surface 16 a locking surface portion 17 and a releasing surface portion 18 (FIGS. 6 to 8). The locking member 15 shown is in the form of a tumbler lock barrel having an outer generally cylindrical surface 16, part of which forms the locking surface portion 17. A recess 19 formed in the cylindrical surface 16 creates the releasing surface portion 18. The section 20 of the body 1 surrounding the lock barrel 15 may function in the manner of a conventional tumbler lock cylinder.

Figure 9:
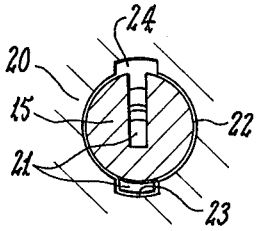
FIG. 9 is a partial cross-sectional view of the construction shown in the preceding figures and showing the lock tumblers in the locked condition.
Figure 10:
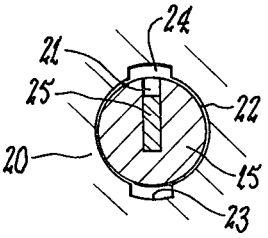
FIG. 10 is a view similar to FIG. 9 but showing the tumblers withdrawn to the unlocked condition by a key.

In the example shown, the barrel 15 is held against rotation relative to the body 1 by disc tumblers 21 extending across the separation line 22 between the barrel 15 and body 1 and protruding into a locking cavity 23 or 24 of the body section 20 (FIG. 9). That is, the barrel 15 can adopt either of two locking positions which are 180° apart and the consequence of that will be hereinafter explained. The barrel 15 is released for rotation relative to the body 1 by inserting an appropriate key 25 (FIG. 10) into the keyway 26 and thereby drawing the discs 21 into the barrel 15 so as to be clear of the cavities 23 and 24. Withdrawal of the key 25 is only possible at each of the two locking positions of the barrel 15 and the discs 21 are spring influenced in a known manner to project from the barrel 15 when freed of the influence of the key 25.

The lock barrel 15 of the construction shown extends substantially parallel to the passage 3 and although the passages 2 and 3 are shown laterally spaced apart, they may intersect under some circumstances. If the barrel 15 is arranged transverse to both passages 2 and 3, the passages may be spaced or they may intersect, according to requirements.

In the construction shown, the passages 2 and 3 are located on respective opposite sides of the lock barrel 15 so as to be spaced apart in the longitudinal direction of the body 1. The lock barrel 15 is arranged so that rotation thereof to present the releasing portion 18 to one of the passages 2 or 3 simultaneously presents the locking portion 17 to the other, and vice versa, so that the lock barrel 15 is capable of being operatively associated with either of the passages 2 and 3. With the arrangement shown, the lock barrel 15 is rotatable through 180° to move the releasing portion 18 from one passage 2 or 3 to the other.

Figure 4:
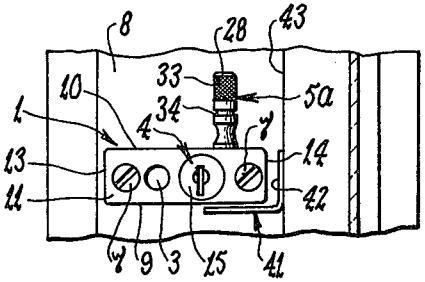
FIG. 4 is a plan view of the assembly shown in FIG. 2 but showing the locking bar drawn into the inoperative position.
Figure 5:
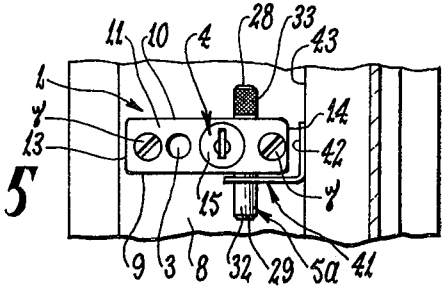
FIG. 5 is a view similar to FIG. 4 but showing the locking bar in the operative position.

Each passage 2 and 3 is capable of slidably receiving the locking bar 5 and that has a locking recess 27 provided at a location between its ends 28 and 29. It is usually intended to have such a bar 5 located within only one of the passages 2 and 3 at any time and the bar 5 is longitudinally movable within the selected passage 2 or 3 between a projecting operative position (FIGS. 5 and 6) and a retracted inoperative position (FIG. 4 and 8). The recess 27 in the locking bar 5 is preferably in the form of a circumferential groove and is located within the body 1 when the bar 5 is in its operative position. Thus, when the bar 5 is in the passage 2 as shown in FIG. 6, the recess 27 is arranged to be influenced by the barrel 15 to retain the bar 5 against longitudinal movement relative to the body 1. The bar 5 however, is movable longitudinally in the passage 2 when the rotational position of the lock barrel 15 is such that the releasing portion 18 is adjacent the bar 5 as shown in FIG. 7.

The locking bar 5 is preferably in the form of a generally cylindrical rod as shown. The locking recess 27 is a necked portion of the bar 5 having a greater width than depth, and the necked portion is continuously contoured up to the cylindrical surface of the bar 5.

In the preferred embodiment shown, the passage 2 is located so as to intrude into one side of the bore 30 of the body 1 containing the lock barrel 15. The arrangement is such that when the bar 5 is positioned in the passage 2 as shown in FIG. 6, it can be retained against longitudinal movement by direct engagement or intrusion of the locking portion 17 in the recess 27. For that purpose, the recess 27 is preferably complementary in shape to the outer surface 16 of the lock barrel 15, or at least the part of the surface 16 which constitutes the locking portion 17. The bar 5 is therefore released for longitudinal movement by rotating the barrel 15 to remove the locking portion 17 from the recess 27 and locating the releasing portion 18 of the lock barrel 15 adjacent the passage 2.

Figures 11, 12, 13, 14:
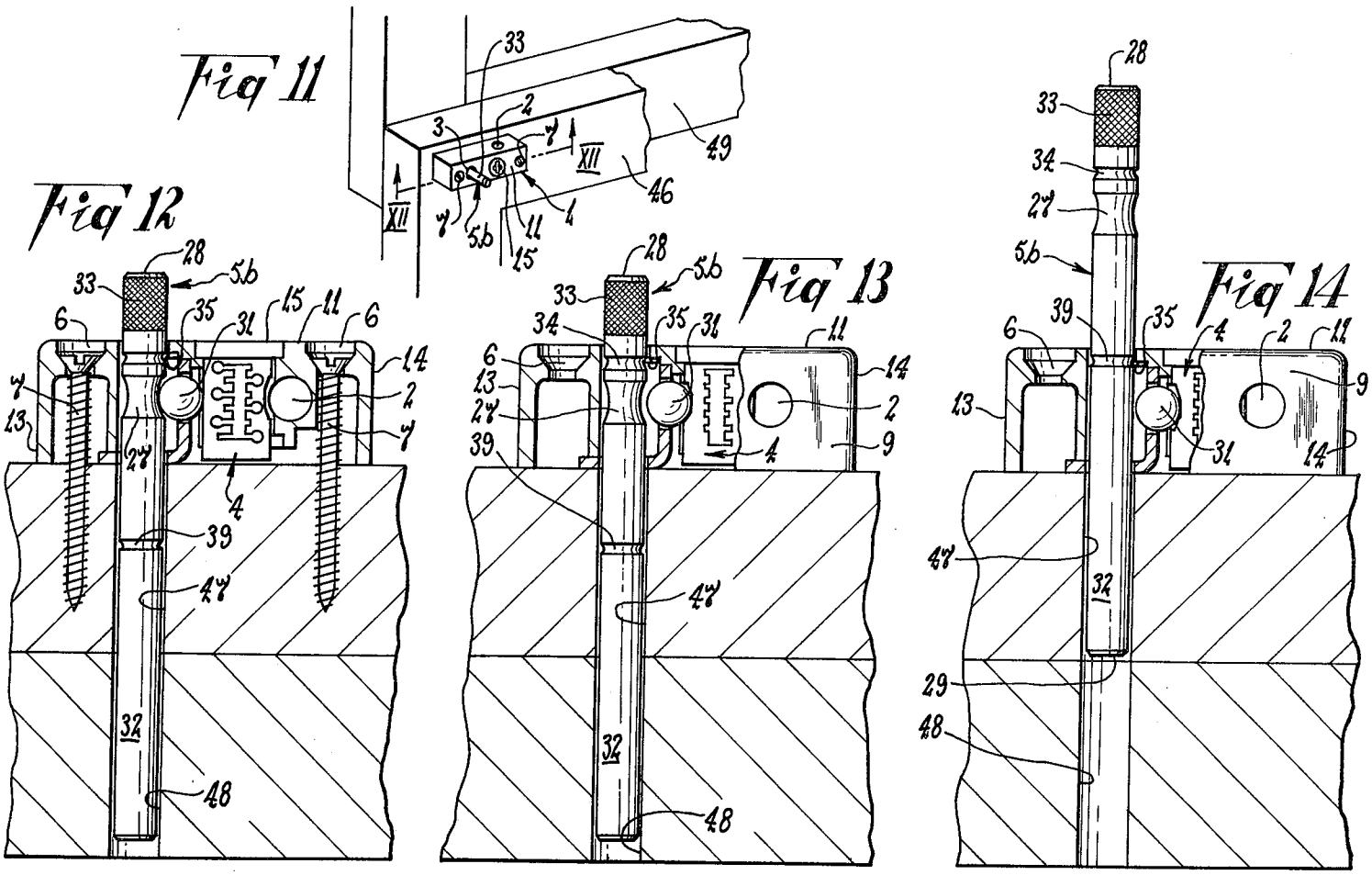
FIG. 11 is a perspective view of the lock mounted in a different condition of operation.
FIG. 12 is a cross-sectional view taken along line XII—XII of FIG. 11.
FIG. 13 is a view similar to FIG. 12 but showing the locking means in the unlocked condition.
FIG. 14 is a view similar to FIG. 13 but showing the locking bar withdrawn into the inoperative position.

When the bar 5 is located in the passage 3 as shown in FIGS. 11 to 14, it is spaced from the lock barrel 15 so as not to be capable of direct influence by that barrel 15. For that purpose, the locking means 4 includes an intermediate locking member 31 which is located between the passage 3 and the lock barrel 15. The intermediate locking member 31 is arranged to be engageable in the recess 27 of the locking bar 5 when the locking portion 17 is adjacent the passage 3 as shown in FIG. 12. The intermediate locking member 31 is preferably a spherical member, such as a suitably sized metal ball, and which is arranged for direct engagement by the lock barrel 15. The locking member 31 is movable between a locking position where it projects into the passage 3 so as to intrude into the recess 27 of the locking bar 5 (FIG. 12), and a releasing position where it is clear of the recess 27 and permits sliding movement of the bar 5 in the passage 3.

It will be apparent from FIGS. 12 to 14 that the locking member 31 is responsive to changes in the rotational position of the lock barrel 15. In the FIG. 12 condition, the locking portion 17 presses against the locking member 31 to prevent retraction of that member 31 from its locking engagement within the recess 27. In the FIG. 13 condition, the releasing portion 18 is aligned with the locking member 31 so allowing the member 31 to be cammed out of the recess 27 in response to longitudinal movement of the bar 5 and consequently, the bar 5 can be shifted to the inoperative position as shown in FIG. 14. Obviously, other constructions and arrangements could be adopted to achieve the same result—namely, influence of the primary locking member 15 on the bar 5 regardless of which passage 2 or 3 contains the bar 5.

The lock may be provided with two or more bars 5 of different lengths so that it can be used in any one of several possible modes of operation. For example, FIGS. 1 to 8 show the lock used with a relatively short bar 5*a*, whereas a longer bar 5*b* is shown in FIGS. 12 to 14. Each of the bars 5*a* and 5*b* is usable in either of the two passages 2 and 3 thereby adding to the versatility of the lock. Furthermore, bar 5*a* or 5*b* may be reversible so that its locking end portion 32 can project from either end of the passage 2 or 3 in which it is contained. That is, the bar 5*a* or 5*b* can adopt either of two operative positions for each passage 2 and 3. The bars 5*a* and 5*b* are arranged to be manually withdrawn from the projecting operative position (FIGS. 5 and 12) to the retracted inoperative position (FIGS. 4 and 14) and for that purpose the end portion 33 of the bar 5*a* and 5*b* may be provided with a non-slip surface such as by knurling.

The lock may also include locating means for releasably holding the locking bar 5 at a position in the body 1 so that the locking recess 27 is in the correct position for engagement by the locking means 4. For example, in an arrangement not shown, the locating means may comprise a ball which is spring biased towards the passage 2 or 3 and located on the opposite side of the passage 2 or 3 to the lock barrel 15. The ball is arranged to be engageable with the recess 27 to locate the bar 5 in the operative position.

In the preferred construction shown, the locating means includes a retaining groove 34 formed in the locking bar 5 at a position spaced from the locking recess 27 and which is engageable by retaining means 35 mounted in the body 1. The retaining means 35 may comprise a spring (FIG. 3) of generally U-shaped configuration which for passage 2, is located in a recess 36 of the body 1 (FIGS. 6 to 8). For passage 3, a similar spring 35 is located at an appropriate position within the body 1 as shown in FIGS. 12 to 14. In each case, the retaining spring 35 is located to one side of the respective passage 2 or 3 so that it can engage in the groove 34 when the locking recess 27 is in the desired position.

Figure 15:
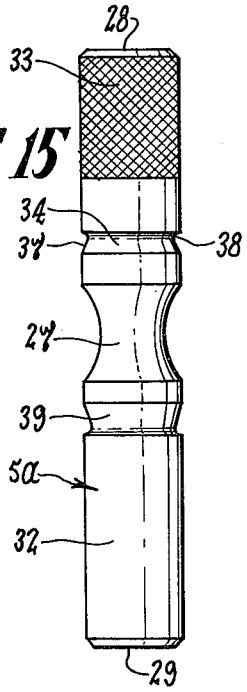
FIG. 15 is an enlarged elevational view of one form of locking bar for use with the lock according to the invention.

As best seen in FIG. 15, retaining groove 34 preferably has a sloping surface 37 facing towards the adjacent end 28 of the bar 5 and which is operative to ramp the retaining spring 35 out of engagement with the groove 34 when the bar 5 is withdrawn from the projecting operative position. The opposite side 38 of the groove 34 is preferably formed as an abrupt step to firmly resist movement of the bar 5 past its operative position in the direction away from its inoperative position.

The locating means may also include a second retaining groove 39 which functions to resist complete removal of the bar 5 from the body 1 when moving away from the operative position. Preferably, the groove 39 is similar in form to the groove 34 described above and the two grooves 34 and 39 are located on opposite sides of the locking recess 27 so that the groove 39 is engaged by the retaining spring 35 when the bar 5 is in the inoperative position (FIGS. 8 and 14).

The locking bar 5 may be reversible in the passage 2 or 3 so that the lock can be used with the locking end portion 32 of the bar 5 projecting beyond either of two sides of the body 1. For that purpose, the retaining spring 35 may be located at the appropriate side of the body 1 and means for locating the spring 35 is provided at each of those sides.

The lock as described above may be used in many different situations without modification, because of the choice of different bar lengths and provision of two or more angularly disposed bar receiving passages. For example, in the case of use with an awning window as shown in FIGS. 2 to 5, the lock body 1 may be mounted on the window sill 8 with the side 11 facing upwardly. A striker or L-shaped bracket 41 may be secured by one leg 42 to the bottom rail 43 of the window sash so that when the window is closed the other leg 44 of the bracket 41 lies along the side 9 of the lock. In that position, a hole 45 in the leg 44 is aligned with the passage 2 in the lock body 1. With this arrangement a short locking bar **5*a* located in the passage 2 can be used to lock the window by selective engagement in the hole 45 in the bracket 41**.

In the case of a double hung window (FIG. 11) the lock body 1 may be mounted to the top rail 46 of the lower sash with the side 11 facing into the room. A bore 47 can be drilled through the top rail 47 so as to be capable of alignment with another bore 48 provided in the bottom rail 49 of the upper sash in a closed condition of the window. A long locking bar **5*b* may then be used in the passage 3** to lock the sashs in their closed position.

The lock can also be used for sliding doors by mounting the lock body 1 at the bottom of the door with the side 11 facing outwardly. The passage 2 can receive a short locking bar **5*a* which is arranged to pass vertically through the body 1 to selectively engage in one or more apertures provided in the door step so that the door can be locked in a fully closed position or in one or more partially opened positions. Alternatively the lock may be secured to the door face at the top thereof and the bar 5*a*** may be movable vertically into holes provided in the door frame header adjacent to the guide groove.

For horizontal sliding windows the lock body 1 can be secured to the window sill and the locking bar can pass through the body into holes provided in the bottom rail of the window sash.

Thus, it will be seen that the lock according to the present invention can be used in many different situations without modification.

Finally, it is to be understood that various minor alterations and modifications may be made to the constructions and arrangements of parts as hereinbefore described without departing from the spirit or ambit of the invention as defined by the appended claims.

We claim:

1. A lock including a six sided body adapted to be secured to a support, two passages extending completely through said body, one of said passages extending between an opposite two of said sides and the other said passage extending between another two said sides, a locking bar slidably receivable in either of said passages to be slidable therein for longitudinal movement relative to said body between an operative position and an inoperative position, said bar being insertable into either end of one of said passages and having a locking end portion which protrudes from an end of a selected said passage at least in said operative position, a recess in said locking bar intermediate the ends thereof, a primary locking member movably mounted on said body for movement between a locking position and an unlocking position, said primary locking member protruding into said recess and thereby holding said bar against said longitudinal movement when said bar is located in said one passage and is in said operative position and said primary locking member is in said locking position, and an intermediate locking member movably mounted on said body and being responsive to movement of said primary locking member into said locking position to protrude into said recess when said locking bar is in said other passage and is in said operative position.

2. A lock according to claim 1, wherein said primary locking member includes a cylindrical member rotatably mounted in said body and having on its radially outer surface a locking portion and a releasing portion, and said locking bar is secured against or released for movement relative to said body according to whether said locking portion or said releasing portion respectively is adjacent the said passage in which said locking bar is located.

3. A lock according to claim 2, wherein said locking portion protrudes into said recess to hold said locking bar against longitudinal movement relative to said body when said locking bar is located in said one passage, and said intermediate locking member is influenced by said locking portion to protrude into said recess when said locking bar is located in the said other passage.

4. A lock according to claim 3 wherein said intermediate locking member is a spherical member.

5. A lock according to claim 2, wherein said cylindrical member carries a plurality of tumbler elements which are movable radially of said cylindrical member to project beyond the radially outer surface thereof and engage with said body to hold said cylindrical member against rotation relative thereto, and a keyway is provided within said cylindrical member to receive a key which is operative to retract said tumbler elements from their body engaging position and thereby free said cylindrical member for rotation relative to said body.

6. A lock according to claim 5, wherein said tumbler elements are engageable with said body in either of two rotational positions of said cylindrical member which are 180° apart, and said locking portion is adjacent a respective one of said passages in each of those rotational positions.

7. A lock according to claim 6, wherein said locking and releasing portions are disposed 180° apart around the circumference of said cylindrical member.

8. A lock according to claim 1, wherein locating means is operative to releasably locate said locking bar in said operative position independent of operation of said locking members.

9. A lock according to claim 8, wherein said locating means includes a spring located within said body and a retaining groove formed in said bar and arranged to receive a portion of said spring when the bar is in said operative position.

10. A lock according to claim 9, wherein a further retaining groove is provided in said locking bar and is engaged by said spring when the locking bar is located at said inoperative position, said spring co-operating with said further retaining groove to resist movement of said locking bar beyond said inoperative position in a direction away from said operative position.

* * * * *